US011136868B1

(12) United States Patent
Alqurashi et al.

(10) Patent No.: US 11,136,868 B1
(45) Date of Patent: Oct. 5, 2021

(54) AQUEOUS FLASH TREATMENT IN WELL APPLICATIONS

(71) Applicant: Saudi Arabian Oil Company, Dhahran (SA)

(72) Inventors: Mahmoud Adnan Alqurashi, Dhahran (SA); Ossama R. Sehsah, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/011,743

(22) Filed: Sep. 3, 2020

(51) Int. Cl.

| | |
|---|---|
| ***E21B 36/00*** | (2006.01) |
| ***E21B 43/34*** | (2006.01) |
| ***E21B 43/24*** | (2006.01) |
| ***E21B 47/003*** | (2012.01) |
| ***E21B 47/07*** | (2012.01) |

(52) U.S. Cl.
CPC ..... *E21B 43/2405* (2013.01); *E21B 36/00* (2013.01); *E21B 43/35* (2020.05); *E21B 47/003* (2020.05); *E21B 47/07* (2020.05)

(58) Field of Classification Search
CPC ..... E21B 43/2405; E21B 36/00; E21B 43/35; E21B 47/07; E21B 47/003
See application file for complete search history.

(56) References Cited

U.S. PATENT DOCUMENTS

| | | | | |
|---|---|---|---|---|
| 1,794,045 | A | 2/1931 | Warner | |
| 1,839,764 | A | 1/1932 | Kittredge et al. | |
| 1,998,732 | A | 4/1935 | Olds | |
| 2,427,361 | A * | 9/1947 | Lofgren | F22B 1/281 219/628 |
| 3,854,032 | A | 12/1974 | Cooper | |
| 3,918,411 | A | 11/1975 | Wolowodiuk | |
| 4,357,520 | A | 11/1982 | Taylor | |
| 4,621,186 | A | 11/1986 | Taylor et al. | |
| 5,616,265 | A | 4/1997 | Altman | |
| 5,805,765 | A * | 9/1998 | Altman | F22B 1/284 392/324 |
| 5,840,100 | A * | 11/1998 | Arencibia, Jr. | B01D 47/06 95/225 |
| 7,145,114 | B2 * | 12/2006 | Wakamatu | B24B 49/105 219/629 |
| 9,253,824 | B2 | 2/2016 | Inoue | |
| 11,008,241 | B2 * | 5/2021 | Carew | C02F 11/125 |
| 2004/0200550 | A1 * | 10/2004 | Pfaffmann | B21D 26/047 148/526 |

FOREIGN PATENT DOCUMENTS

| | | |
|---|---|---|
| DE | 102005026534 | 12/2006 |

* cited by examiner

*Primary Examiner* — Giovanna Wright
*Assistant Examiner* — Jonathan Malikasim
(74) *Attorney, Agent, or Firm* — Fish & Richardson P.C.

(57) ABSTRACT

An apparatus includes a vessel, a vent valve, a helical heating element, and a control system. The vessel includes an inlet, a solids outlet, and a steam outlet. The helical heating element is configured to generate heat, thereby vaporizing water in an aqueous fluid to produce steam. The helical heating element includes multiple coils, and a spacing between adjacent coils is adjustable. The control system includes multiple sensors and a controller. The controller is configured to transmit a spacing adjustment signal to adjust the spacing between adjacent coils of the helical heating element and transmit a heating adjustment signal to adjust an amount of heat produced by the helical heating element.

17 Claims, 6 Drawing Sheets

AQUEOUS FLASH TREATMENT IN WELL APPLICATIONS

TECHNICAL FIELD

This disclosure relates to water handling in well operations.

BACKGROUND

Water is a factor that is typically considered throughout the life of a well. The term water cut (or water saturation) relates to a percentage of a subterranean formation's pore volume that is filled with water. As hydrocarbons are depleted from a reservoir, the decrease in reservoir pressure allows for increased water migration into the rock formations, resulting in an increase in water cuts over time. In some cases, produced water is injected back into the subterranean formation. In some cases, produced water is used in hydraulic fracturing. In some cases, produced water is treated and disposed.

SUMMARY

This disclosure describes technologies relating to water handling in well operations. Flaring and cleanup operations can often times be disruptive and interrupt well operations. The subject matter described in this disclosure can be implemented in particular implementations, so as to realize one or more of the following advantages. The apparatus, system, and method described herein can be implemented to efficiently and continuously vaporize water and vent the produced steam, such that operations can continue without interruption. The apparatus, system, and method described herein can be implemented to avoid sending heavy fluids, such as brine, to a flare, which can disrupt and/or interrupt well operations. The apparatus and system described herein can automatically adjust heating rate based on various factors, such as measured volume intake, measured rheology, and measured temperature in order to efficiently and quickly vaporize water. The spacing between adjacent coils of a helical heating element can be adjusted to improve water vaporization.

Certain aspects of the subject matter described can be implemented as an apparatus. The apparatus includes a vessel, a vent valve, a helical heating element, and a control system. The vessel includes an inlet, a solids outlet, and a steam outlet. The inlet is configured to receive an aqueous fluid. The solids outlet is configured to discharge solids from the vessel. The steam outlet is configured to discharge steam from the vessel. The vent valve is positioned at the steam outlet. The helical heating element is positioned within the vessel. The helical heating element is configured to generate heat in response to receiving power, thereby vaporizing water in the aqueous fluid to produce steam. The helical heating element includes multiple coils. A spacing between adjacent coils of the helical heating element is adjustable. The control system includes multiple sensors and a controller. The sensors are positioned within the vessel. The controller is communicatively coupled to the sensors and the helical heating element. The controller is configured to transmit a spacing adjustment signal to the helical heating element to adjust the spacing between adjacent coils of the helical heating element. The controller is configured to transmit a heating adjustment signal to adjust an amount of heat produced by the helical heating element.

This, and other aspects, can include one or more of the following features.

In some implementations, the sensors include at least one of a liquid volume sensor configured to measure a volume of liquid within the vessel, an intake volume sensor configured to measure a volume of aqueous fluid entering the vessel through the inlet, a temperature sensor configured to measure a temperature within the vessel, or a rheology sensor configured to measure a rheology of liquid within the vessel.

In some implementations, the controller is communicatively coupled to a generator. In some implementations, the controller is configured to transmit the heating adjustment signal to the generator, thereby adjusting a power provided by the generator to the helical heating element to adjust the amount of heat produced by the helical heating element.

In some implementations, the generator includes a diesel engine.

In some implementations, the vessel includes a chimney stack configured to direct steam to the steam outlet.

Certain aspects of the subject matter described as a system. The system includes a brine storage tank positioned on an offshore rig, a generator, and an apparatus in fluid communication with the brine storage tank. The apparatus includes a vessel, a vent valve, a helical heating element, and a control system. The vessel includes an inlet, a solids outlet, and a steam outlet. The inlet is configured to receive an aqueous fluid. The solids outlet is configured to discharge solids from the vessel. The steam outlet is configured to discharge steam from the vessel. The vent valve is positioned at the steam outlet. The helical heating element is positioned within the vessel. The helical heating element is configured to generate heat in response to receiving power, thereby vaporizing water in the aqueous fluid to produce steam. The helical heating element includes multiple coils. A spacing between adjacent coils of the helical heating element is adjustable. The control system includes multiple sensors and a controller. The sensors are positioned within the vessel. The controller is communicatively coupled to the sensors and the helical heating element. The controller is configured to transmit a spacing adjustment signal to the helical heating element to adjust the spacing between adjacent coils of the helical heating element. The controller is configured to transmit a heating adjustment signal to adjust an amount of heat produced by the helical heating element.

This, and other aspects, can include one or more of the following features.

In some implementations, the sensors include at least one of a liquid volume sensor configured to measure a volume of liquid within the vessel, an intake volume sensor configured to measure a volume of brine entering the vessel through the inlet, a temperature sensor configured to measure a temperature within the vessel, or a rheology sensor configured to measure a rheology of liquid within the vessel.

In some implementations, the generator includes a diesel engine.

In some implementations, the vessel includes a chimney stack configured to direct steam to the steam outlet.

In some implementations, a bottom of the vessel is sloped downward toward the solids outlet.

Certain aspects of the subject matter described can be implemented as a method.

An aqueous fluid is received at an inlet of a vessel. A temperature of the aqueous fluid within the vessel is measured. A volume of the aqueous fluid within the vessel is measured. Water in the aqueous fluid is vaporized using a helical heating element positioned within the vessel to produce steam. Vaporizing water in the aqueous fluid using the helical heating element includes, based on the measured temperature and measured volume, adjusting a spacing between adjacent coils of the helical heating element and adjusting a power provided to the helical heating element, thereby adjusting an amount of heat produced by the helical heating element. The steam is discharged from a steam outlet of the vessel.

This, and other aspects, can include one or more of the following features.

In some implementations, a volume of the aqueous fluid entering the vessel through the inlet is measured. In some implementations, a rheology of the aqueous fluid within the vessel is measured.

In some implementations, power is provided to the helical heating element using a generator that includes a diesel engine.

In some implementations, steam is directed to the steam outlet using a chimney stack of the vessel.

In some implementations, solids are discharged from a solids outlet of the vessel.

In some implementations, solids are directed to the solids outlet using a bottom of the vessel that is sloped downward toward the solids outlet.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes an electric steam generator which can, for example, be used for offshore applications. The steam generator quickly vaporizes (and in some cases, superheats) water in aqueous fluids (for example, brine). The steam generator includes sensors and an integrated controller (for example, a programmable logic controller) which can automatically adjust parameters to optimize heating efficiency. The steam generator includes an adjustable coil that can be adjusted by the controller.

Figure 1:
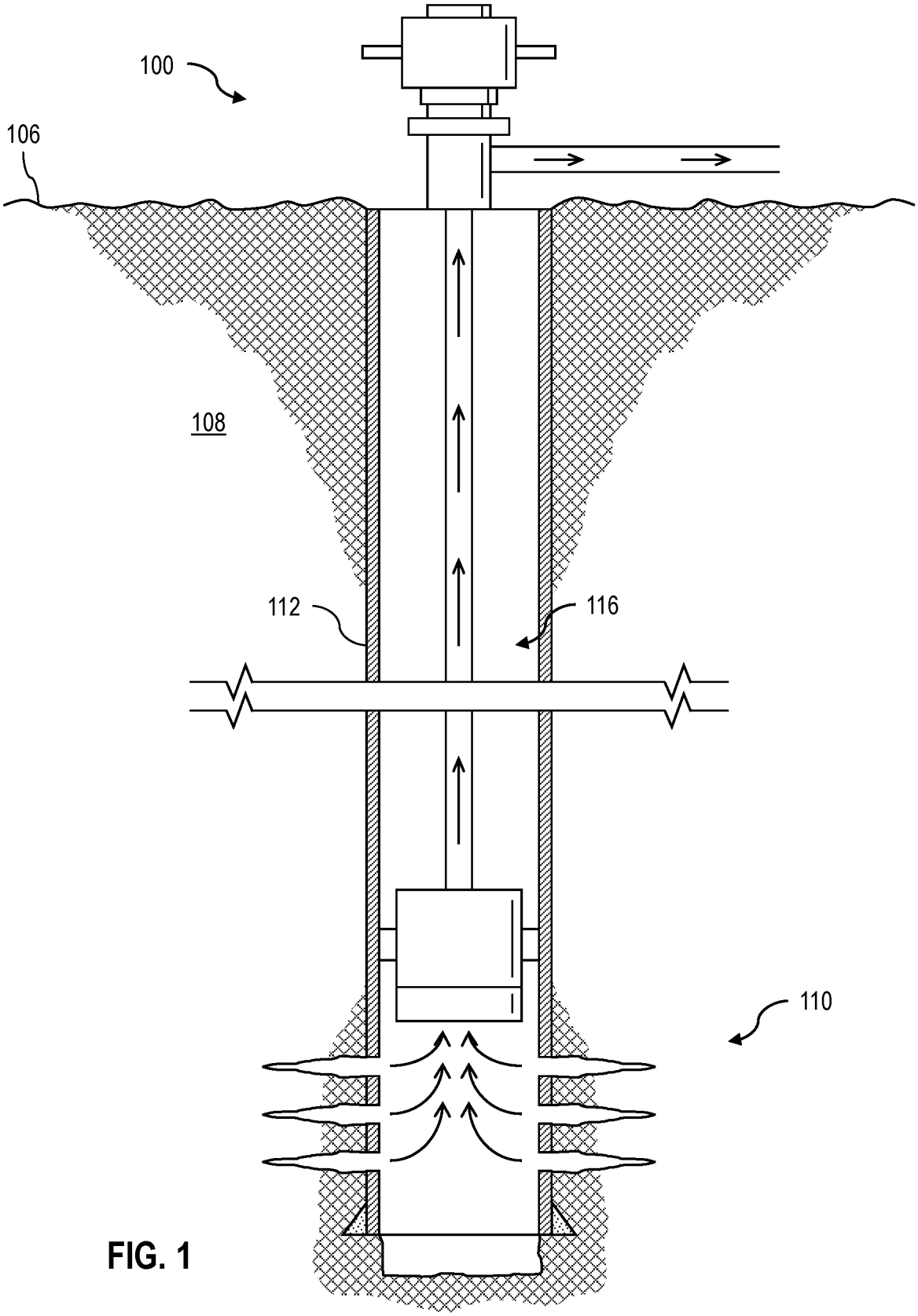
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth. Further, the concepts herein are applicable to offshore wells that include wellbores drilled below a seabed.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole." In particular, casing 112 is commercially produced in a number of common sizes specified by the American Petroleum Institute (the "API"), including 4-½, 5, 5-½, 6, 6-⅝, 7, 7-⅝, 7-¾, 8-⅝, 8-¾, 9-⅝, 9-¾, 9-⅞, 10-¾, 11-¾, 11-⅞, 13-⅜, 13-½, 13-⅝, 16, 18-⅝, and 20 inches, and the API specifies internal diameters for each casing size.

The wellhead defines an attachment point for other equipment to be attached to the well 100. For example, FIG. 1 shows well 100 being produced with a Christmas tree attached to the wellhead. The Christmas tree includes valves used to regulate flow into or out of the well 100.

Figure 2A:
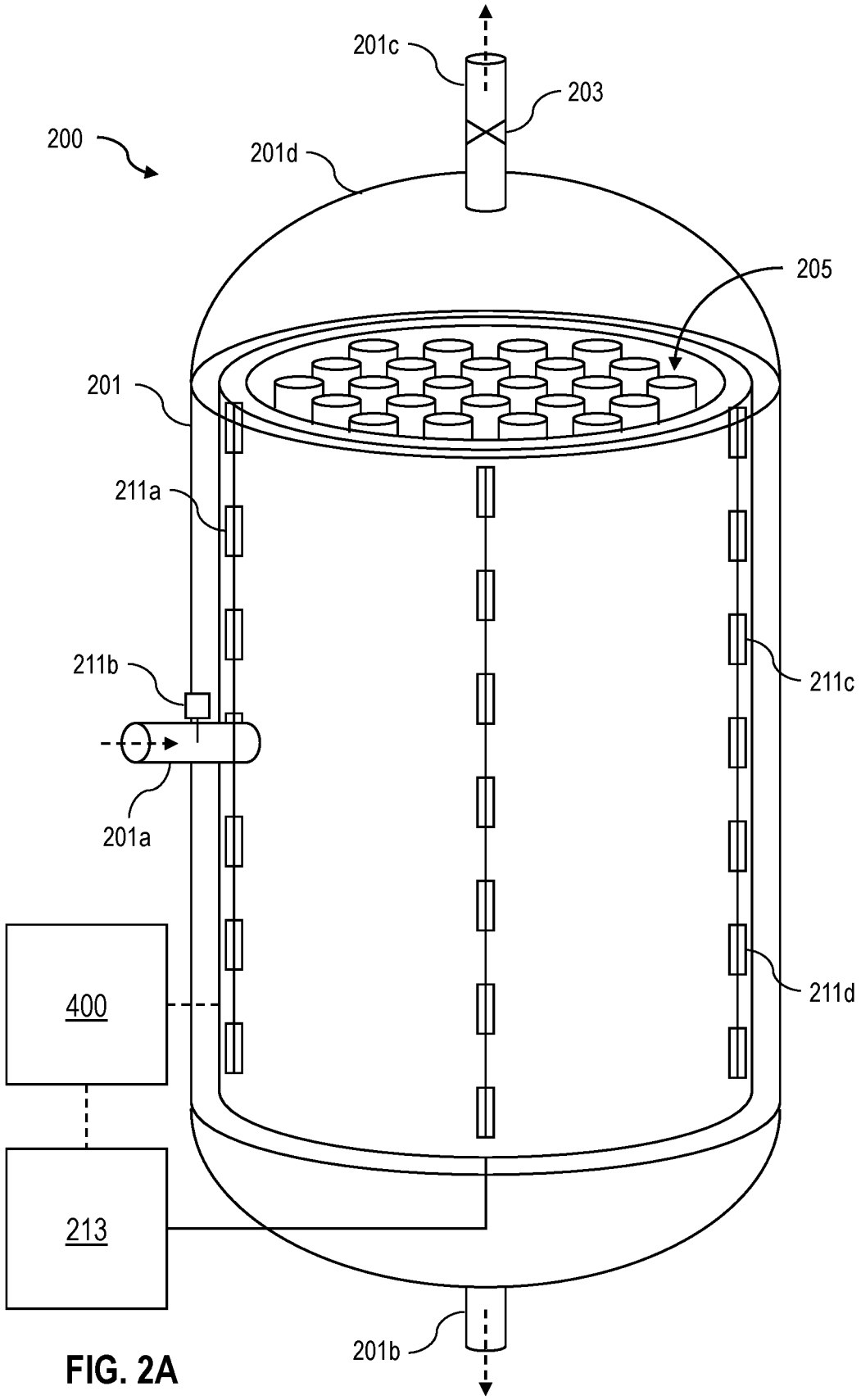
FIG. 2A is a schematic diagram of an example apparatus that can be implemented in a cleanup operation associated with the well of FIG. 1.

FIG. 2A is a schematic diagram of an apparatus 200 that can be implemented in a cleanup operation associated with the well 100. The apparatus 200 includes a vessel 201, a vent valve 203, a helical heating element 205, and a control system 250. The vessel 201 includes an inlet 201*a* configured to receive an aqueous fluid, such as brine. The vessel 201 includes a solids outlet 201*b* configured to discharge solids, such as salt, from the vessel 201. The vessel 201 includes a steam outlet 201*c* configured to discharge steam from the vessel 201. The vent valve 203 is positioned at the steam outlet 201*c*. The helical heating element 205 is positioned within the vessel 201.

In some implementations, the vessel 201 includes a chimney stack 201*d* configured to direct steam to the steam outlet 201*c*. The chimney stack 201*d* can be, for example, located at the top of the vessel 201. In some implementations, the bottom of the vessel 201 is sloped downward toward the solids outlet 201*b*, so that solids can fall to the solids outlet 201*b*, for example, by gravity. In some implementations, the apparatus 200 includes a flush system that can flush solids to the solids outlet 201*b*. The flush system can include, for example, a pump.

The vent valve 203 opens and closes at varying degrees to facilitate the rate of venting steam generated within the vessel 201, such that pressure and temperature within the vessel 201 can be controlled. In some cases, the vent valve 203 can serve as a safety valve and fully open to relieve pressure from the vessel 201, especially in cases where the operating pressure exceeds an upper pressure threshold.

The helical heating element 205 is configured to generate heat in response to receiving power. The heat generated by the helical heating element 205 vaporizes water in the aqueous fluid to produce steam. The helical heating element 205 is made of multiple coils, and a spacing 205*a* between adjacent coils of the helical heating element 205 is adjustable. An example of the helical heating element 205 (along with the spacing 205*a*) is shown in FIG. 2C. In some implementations, the spacing 205*a* between adjacent coils is uniform for the entire helical heating element 205, and each spacing 205*a* can be simultaneously adjusted, such that the spacings 205*a* remain uniform throughout operation of the apparatus 200. In some implementations, the spacing 205*a* between adjacent coils can be different for different pairs of coils. In such implementations, the spacings 205*a* can be individually adjusted as desired. By adjusting the level of power provided to the helical heating element 205 and adjusting the spacings 205*a*, heating within the vessel 201 can be finely tuned to efficiently and quickly vaporize water in the aqueous fluid within the vessel 201. The tuning of power level provided to the helical heating element 205 and the spacings 205*a* of the helical heating element 205 can be adjusted real-time to accommodate changes in the feed entering the apparatus 200 via the inlet 201*a*, such as changes in composition and/or contamination (both of which can affect the boiling point of the fluid).

The control system 250 includes multiple sensors (individual sensors labeled as number 211 followed by a letter) and a controller 400. The sensors are distributed across the apparatus 200. For example, at least some of the sensors are distributed around a circumference within the vessel 201. For example, at least some of the sensors are distributed along a longitudinal length of the vessel 201. The distribution of the sensors across the apparatus 200 can allow for multiple measurements to be taken across the entirety of the apparatus 200. In some implementations, the sensors include at least one of a liquid volume sensor 211*a*, an intake volume sensor 211*b*, a temperature sensor 211*c*, or a rheology sensor 211*d*. The liquid volume sensor 211*a* can be configured to measure a volume of liquid within the vessel 201. For example, the liquid volume sensor 211*a* is a glass level gauge, a float, a displacer, a bubbler, a differential pressure transmitter, a load cell, a magnetic level gauge, or a capacitance transmitter. The intake volume sensor 211*b* can be configured to measure a volume of aqueous fluid entering the vessel 201 through the inlet 201*a*. For example, the intake volume sensor 211*b* is a liquid flow meter. The temperature sensor 211*c* can be configured to measure a temperature within the vessel 201, for example, a temperature of the liquid within the vessel 201. The rheology sensor 211*d* can be configured to measure a rheology of liquid within the vessel 201. For example, the rheology sensor 211*d* is a shear rheometer or an extensional rheometer. The sensors can include a pressure sensor configured to measure a pressure within the vessel 201.

Figure 4:
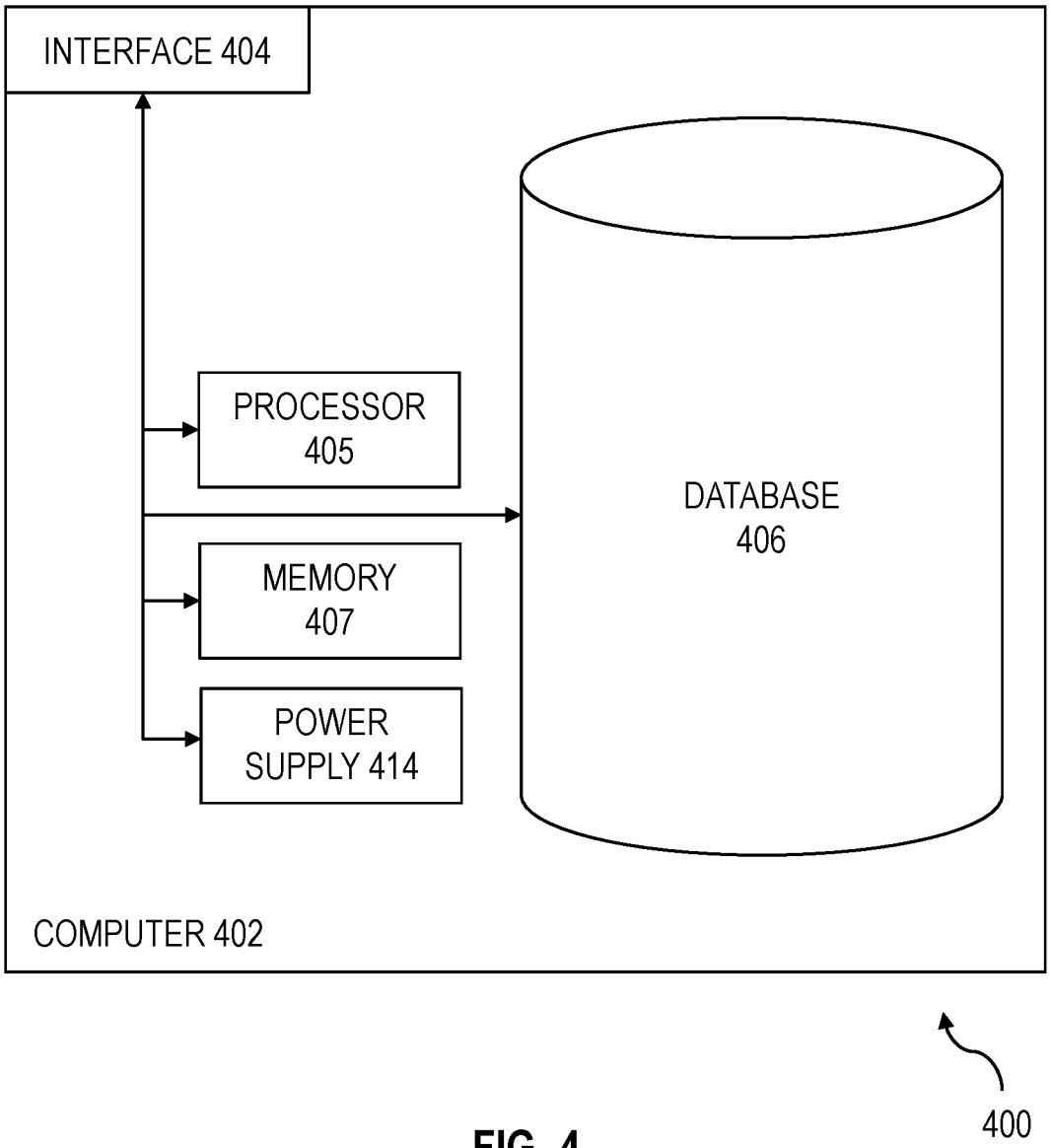
FIG. 4 is a block diagram of an example computer system.

The controller 400 is communicatively coupled to the sensors 211 and the helical heating element 205. The controller 400 receives information from the sensors 211 and determines an amount of heating necessary to vaporize water in the aqueous fluid. The controller 400 can also determine an appropriate distance for the spacing 205*a* and an appropriate level of power to provide to the helical heating element 205 to provide the determined amount of heating necessary to vaporize water in the aqueous fluid. The controller 400 is configured to transmit a spacing adjustment signal to the helical heating element 205 to adjust the spacing 205*a* between adjacent coils of the helical heating element 205. The controller 400 is configured to transmit a heating adjusting signal to adjust an amount of heat produced by the helical heating element 205. The controller 400 can also be communicatively coupled to the vent valve 203 and can be configured to transmit a % open signal to the vent valve 203 to adjust the degree of opening of the vent valve 203. The controller 400 is also shown in FIG. 4 and described in more detail later.

In some implementations, the controller 400 is communicatively coupled to a generator 213. In such implementations, the controller 400 can be configured to transmit the heating adjustment signal to the generator 213, thereby adjusting a power provided by the generator to the helical heating element 205 to adjust the amount of heat produced by the helical heating element 205. In some implementations, the generator 213 includes a diesel engine.

Figure 2B:
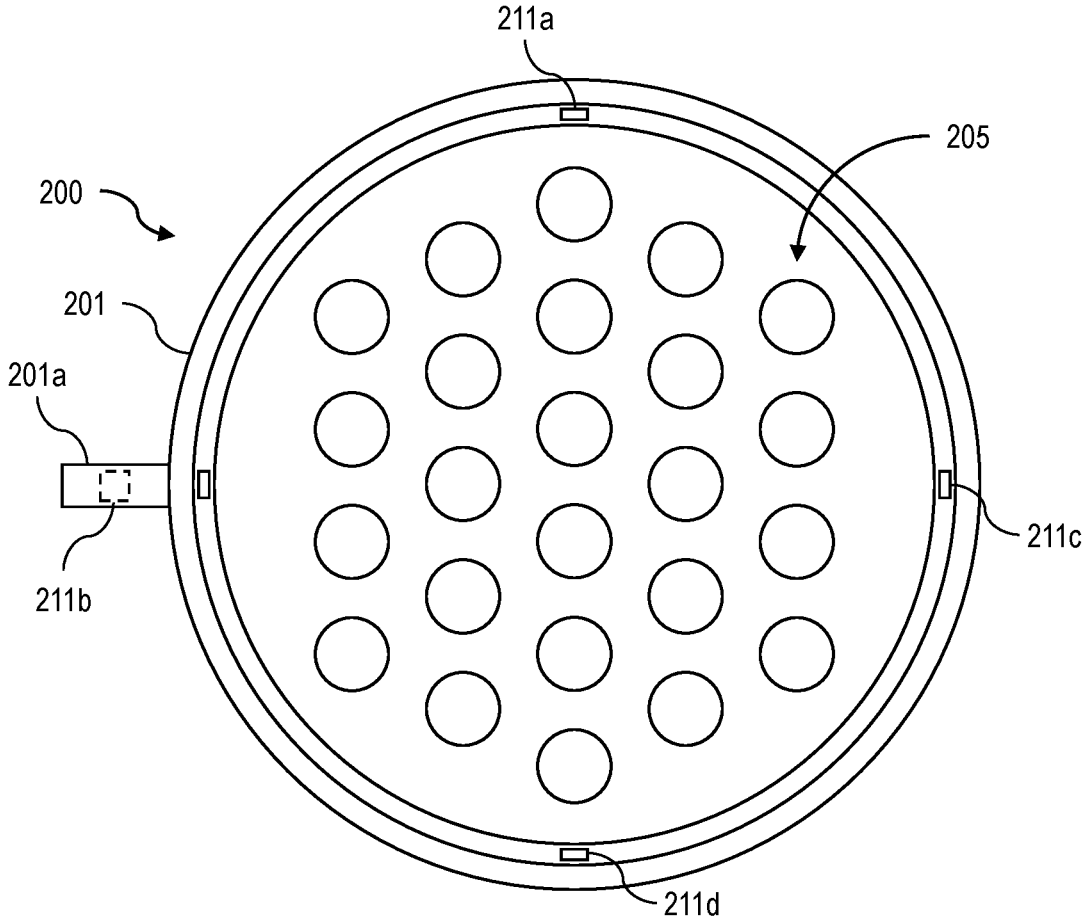
FIG. 2B is a schematic diagram of a cross-section of the apparatus of FIG. 2A.
Figure 2C:
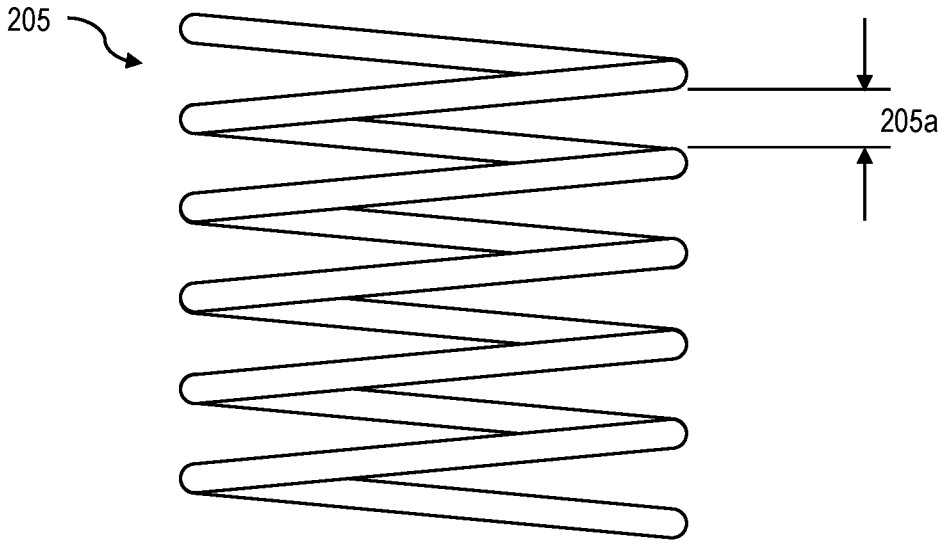
FIG. 2C is a schematic diagram of an example heating element that can be implemented in the apparatus of FIG. 2A.

FIG. 2B is a schematic diagram of a cross-section of the apparatus 200. As shown in FIG. 2B, the apparatus 200 can include multiple helical heating elements 205 distributed within the vessel 201. Although shown in FIG. 2B as being distributed evenly by 4 about the circumference of the vessel 201 (at 0°, 90°, 180°, and 270°), the sensors 211 can be distributed evenly by 2 (for example, at 0° and 180°), 3 (for example, at 0°, 120°, and 240°), 5 (for example, at 0°, 60°, 120°, 180°, and 240°), or more about the circumference of the vessel 201. Although shown in FIG. 2B as being distributed around the circumference of the vessel 201, the sensors 211 can be distributed within the vessel 201 in a different manner. For example, the sensors 211 can alternatively or additionally intermingle with the helical heating elements 205 within the vessel 201.

FIG. 2C is a schematic diagram of an implementation of the helical heating element 205. As described previously, the spacing 205*a* between neighboring coils of the helical heating element 205 is adjustable. In some implementations, the apparatus 200 includes a hydraulic piston mechanism for adjusting the spacing 205*a* of the helical heating element 205. The hydraulic piston mechanism can be controlled by the controller 400.

Figure 2D:
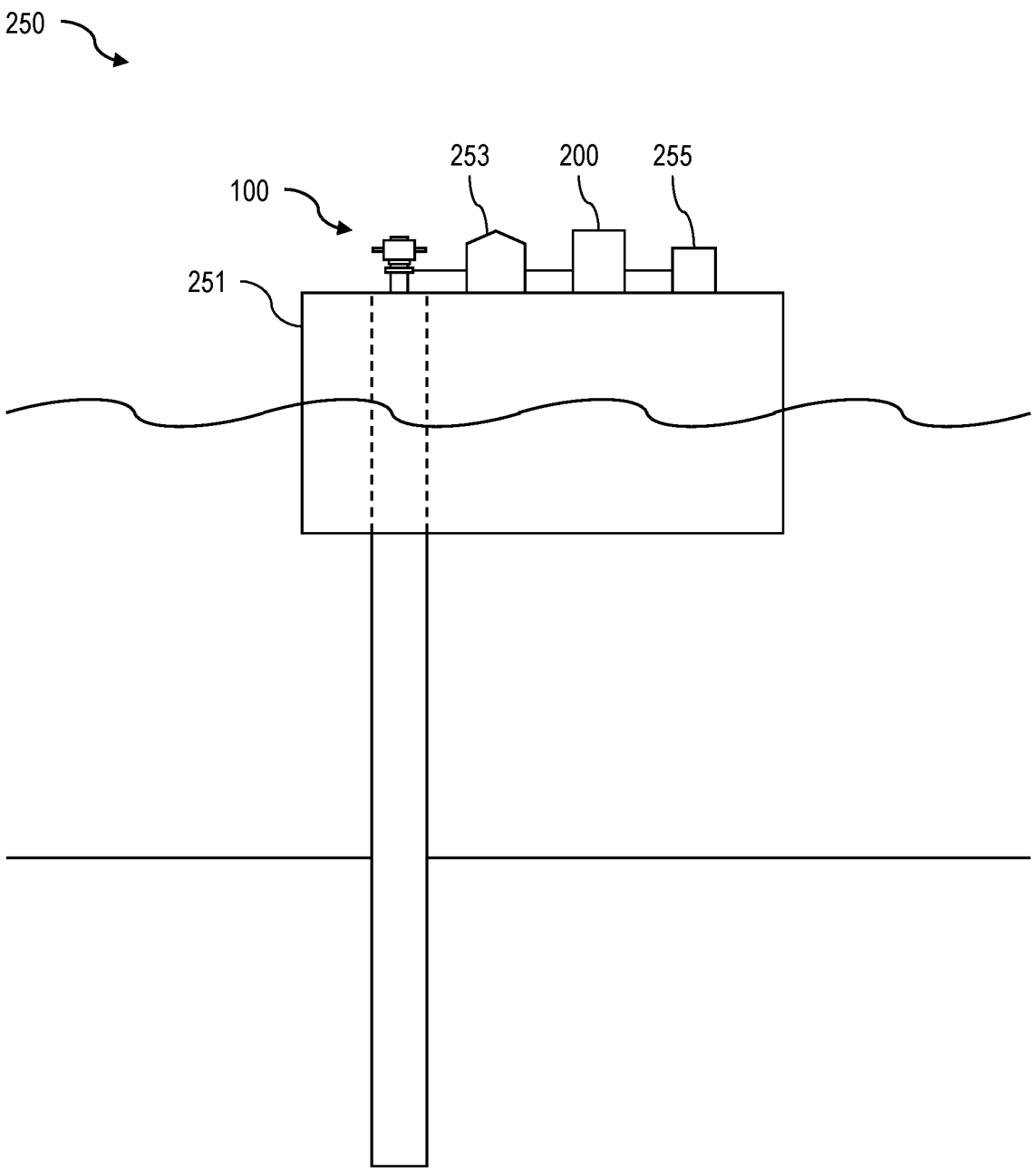
FIG. 2D is a schematic diagram of an example system that includes the apparatus of FIG. 2A.

FIG. 2D is a schematic diagram of a system 250 that includes the apparatus 200. The system 250 includes a rig 251 (for example, an offshore rig) and an implementation of a well 100 installed on the rig 251. The system 250 includes a brine storage tank 253, an implementation of the generator 213, and an implementation of the apparatus 200. The brine storage tank 253, the generator 213, and the apparatus 200 are positioned on the rig 251. The brine storage tank 253 stores brine (for example, produced water or seawater). The apparatus 200 is in fluid communication with the brine storage tank 253.

Figure 3:
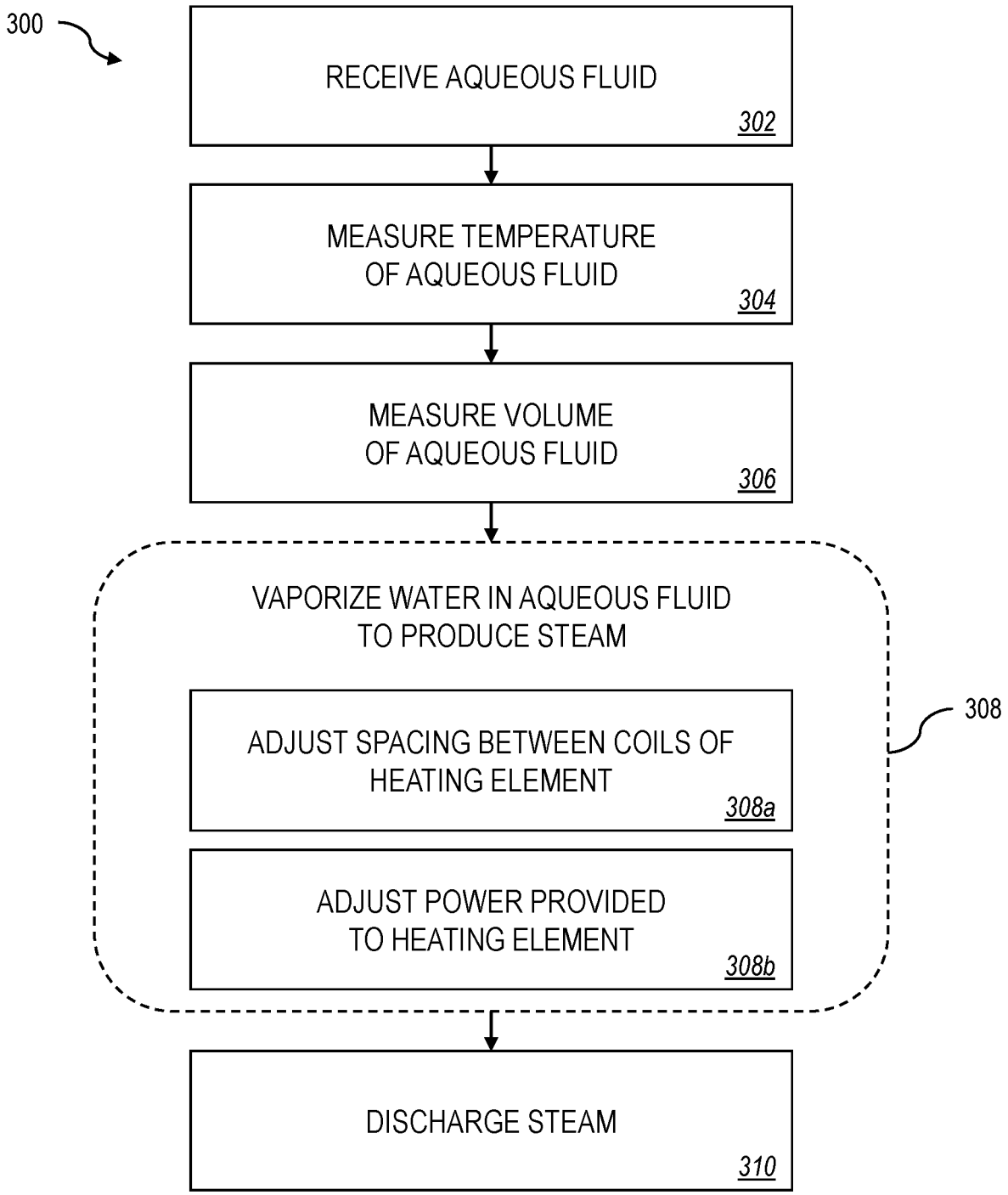
FIG. 3 is a flow chart of an example method that can be implemented by the apparatus of FIG. 2A.

FIG. 3 is a flow chart of a method 300. The method 300 can, for example, be implemented by the apparatus 200. At step 302, an aqueous fluid (for example, brine) is received at an inlet of a vessel (for example, the inlet 201*a* of the vessel 201). The aqueous fluid can be, for example, produced water from a well, completion fluid, fracturing fluid, or seawater.

At step 304, a temperature of the aqueous fluid within the vessel 201 is measured. The temperature can be measured at step 304 using a temperature sensor, for example, positioned within the vessel 201. In some implementations, multiple temperature measurements are taken at various locations within the vessel 201. In such implementations, non-uniform heating and/or an existence of a temperature gradient within the vessel 201 can be detected and accounted for.

At step 306, a volume of the aqueous fluid within the vessel 201 is measured. The volume can be measured at step 306 using a liquid volume sensor, for example, positioned within the vessel 201. In some implementations, a volume of the aqueous fluid entering the vessel 201 through the inlet 201*a* (from step 302) is measured by an intake volume sensor positioned at the inlet 201*a*. In some implementations, a rheology of the aqueous fluid within the vessel 201 is measured by a rheometer positioned within the vessel 201.

At step 308, water in the aqueous fluid is vaporized using a helical heating element (for example, the helical heating element 205) positioned within the vessel 201 to produce steam. Vaporizing water in the aqueous fluid at step 308 includes adjusting a spacing (for example, the spacing 205*a*) between adjacent coils of the helical heating element 205 at step 308*a* based on the measured temperature (from step 304) and measured volume (from step 306). Vaporizing water in the aqueous fluid at step 310 includes adjusting a power provided to the helical heating element 205 at step 308*b*, thereby adjusting an amount of heat produced by the helical heating element 205. In some implementations, power is provided to the helical heating element 205 using a generator that includes a diesel engine (for example, the generator 213).

At step 310, the steam produced from step 308 is discharged from a steam outlet (for example, the steam outlet 201*c*) of the vessel 201. In some implementations, the steam produced from step 308 is directed to the steam outlet 201*c* using a chimney stack (201*d*) of the vessel 201, such that the steam is discharged from the steam outlet 201*c* at step 310.

In some implementations, solids (for example, salt and/or other contaminants that remain in the vessel 201 after the water has evaporated) are discharged from a solids outlet (for example, the solids outlet 201*b*) of the vessel 201. In some implementations, solids are directed to the solids outlet 201*b* using a bottom of the vessel 201 that is sloped downward toward the solids outlet 201*b*, such that the solids are discharged from the solids outlet 201*b*. In some implementations, a flush system is used to direct the solids to the solids outlet 201*b* and discharge the solids from the solids outlet 201*b*.

FIG. 4 is a block diagram of the controller 400 used to provide computational functionalities associated with described algorithms, methods, functions, processes, flows, and procedures, as described in this specification, according to an implementation. The illustrated computer 402 is intended to encompass any computing device such as a server, desktop computer, laptop/notebook computer, one or more processors within these devices, or any other processing device, including physical or virtual instances (or both) of the computing device. Additionally, the computer 402 can include a computer that includes an input device, such as a keypad, keyboard, touch screen, or other device that can accept user information, and an output device that conveys information associated with the operation of the computer 402, including digital data, visual, audio information, or a combination of information.

The computer 402 includes a processor 405. Although illustrated as a single processor 405 in FIG. 4, two or more processors may be used according to particular needs, desires, or particular implementations of the computer 402. Generally, the processor 405 executes instructions and manipulates data to perform the operations of the computer 402 and any algorithms, methods, functions, processes, flows, and procedures as described in this specification.

The computer 402 includes a memory 407 that can hold data for the computer 402 or other components (or a combination of both) that can be connected to the network. Although illustrated as a single memory 407 in FIG. 4, two or more memories 407 (of the same or combination of types) can be used according to particular needs, desires, or particular implementations of the computer 402 and the described functionality. While memory 407 is illustrated as an integral component of the computer 402, memory 407 can be external to the computer 402. The memory 407 can be a transitory or non-transitory storage medium.

The memory 407 stores computer-readable instructions executable by the processor 405 that, when executed, cause the processor 405 to perform operations, such as transmitting a spacing adjustment signal and transmitting a heating adjustment signal. The computer 402 can also include a power supply 414. The power supply 414 can include a rechargeable or non-rechargeable battery that can be configured to be either user- or non-user-replaceable. The power supply 414 can be hard-wired. There may be any number of computers 402 associated with, or external to, a computer system containing computer 402, each computer 402 communicating over the network. Further, the term "client," "user," "operator," and other appropriate terminology may be used interchangeably, as appropriate, without departing from this specification. Moreover, this specification contemplates that many users may use one computer 402, or that one user may use multiple computers 402.

In some implementations, the computer 402 includes an interface 404. Although illustrated as a single interface 404 in FIG. 4, two or more interfaces 404 may be used according to particular needs, desires, or particular implementations of the computer 402. Although not shown in FIG. 4, the computer 402 can be communicably coupled with a network. The interface 404 is used by the computer 402 for communicating with other systems that are connected to the network in a distributed environment. Generally, the interface 404 comprises logic encoded in software or hardware (or a combination of software and hardware) and is operable to communicate with the network. More specifically, the interface 404 may comprise software supporting one or more communication protocols associated with communications such that the network or interface's hardware is operable to communicate physical signals within and outside of the illustrated computer 402.

In some implementations, the computer 402 includes a database 406 that can hold data for the computer 402 or other components (or a combination of both) that can be connected to the network. Although illustrated as a single database 406 in FIG. 4, two or more databases (of the same or combination of types) can be used according to particular needs, desires, or particular implementations of the computer 402 and the described functionality. While database 406 is illustrated as an integral component of the computer 402, database 406 can be external to the computer 402.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. An apparatus comprising:

a vessel comprising:

an inlet configured to receive an aqueous fluid;

a solids outlet configured to discharge solids from the vessel; and a steam outlet configured to discharge steam from the vessel;

a vent valve positioned at the steam outlet;

a helical heating element positioned within the vessel, the helical heating element configured to generate heat in response to receiving power, thereby vaporizing water in the aqueous fluid to produce steam, the helical heating element comprising a plurality of coils, wherein a spacing between adjacent coils of the helical heating element is adjustable; and a control system comprising:

a plurality of sensors positioned within the vessel; and a controller communicatively coupled to the plurality of sensors and the helical heating element, the controller configured to:

transmit a spacing adjustment signal to the helical heating element to adjust the spacing between adjacent coils of the helical heating element; and transmit a heating adjustment signal to adjust an amount of heat produced by the helical heating element.

2. The apparatus of claim 1, wherein the plurality of sensors comprises at least one of a liquid volume sensor configured to measure a volume of liquid within the vessel, an intake volume sensor configured to measure a volume of aqueous fluid entering the vessel through the inlet, a temperature sensor configured to measure a temperature within the vessel, or a rheology sensor configured to measure a rheology of liquid within the vessel.

3. The apparatus of claim 2, wherein the controller is communicatively coupled to a generator, and the controller is configured to transmit the heating adjustment signal to the generator, thereby adjusting a power provided by the generator to the helical heating element to adjust the amount of heat produced by the helical heating element.

4. The apparatus of claim 3, wherein the generator comprises a diesel engine.

5. The apparatus of claim 3, wherein the vessel comprises a chimney stack configured to direct steam to the steam outlet.

6. The apparatus of claim 5, wherein a bottom of the vessel is sloped downward toward the solids outlet.

7. A system comprising:

a brine storage tank positioned on an offshore rig;

a generator; and an apparatus in fluid communication with the brine storage tank, the apparatus comprising:

a vessel comprising:

an inlet configured to receive brine from the brine storage tank;

a solids outlet configured to discharge solids from the vessel; and a steam outlet configured to discharge steam from the vessel;

a vent valve positioned at the steam outlet;

a helical heating element positioned within the vessel and coupled to the generator, the helical heating element configured to generate heat in response to receiving power from the generator, thereby vaporizing water in the brine to produce steam, the helical heating element comprising a plurality of coils, wherein a spacing between adjacent coils of the helical heating element is adjustable; and a control system comprising:

a plurality of sensors positioned within the vessel; and a controller communicatively coupled to the plurality of sensors, the helical heating element, and the generator, wherein the controller is configured to:

transmit a spacing adjustment signal to the helical heating element to adjust the spacing between adjacent coils of the helical heating element; and transmit a heating adjustment signal to the generator to adjust the power provided by the generator to the helical heating element, thereby adjusting an amount of heat produced by the helical heating element.

8. The system of claim 7, wherein the plurality of sensors comprises at least one of a liquid volume sensor configured to measure a volume of liquid within the vessel, an intake volume sensor configured to measure a volume of brine entering the vessel through the inlet, a temperature sensor configured to measure a temperature within the vessel, or a rheology sensor configured to measure a rheology of liquid within the vessel.

9. The system of claim 8, wherein the generator comprises a diesel engine.

10. The system of claim 8, wherein the vessel comprises a chimney stack configured to direct steam to the steam outlet.

11. The system of claim 10, wherein a bottom of the vessel is sloped downward toward the solids outlet.

12. A method comprising:

receiving an aqueous fluid at an inlet of a vessel;

measuring a temperature of the aqueous fluid within the vessel;

measuring a volume of the aqueous fluid within the vessel;

vaporizing water in the aqueous fluid using a helical heating element positioned within the vessel to produce steam, wherein vaporizing water in the aqueous fluid using the helical heating element comprises:

based on the measured temperature and measured volume:

adjusting a spacing between adjacent coils of the helical heating element; and adjusting a power provided to the helical heating element, thereby adjusting an amount of heat produced by the helical heating element; and discharging the steam from a steam outlet of the vessel.

13. The method of claim 12, comprising measuring a volume of the aqueous fluid entering the vessel through the inlet, and measuring a rheology of the aqueous fluid within the vessel.

14. The method of claim 12, comprising providing power to the helical heating element using a generator comprising a diesel engine.

15. The method of claim 12, comprising directing steam to the steam outlet using a chimney stack of the vessel.

16. The method of claim 12, comprising discharging solids from a solids outlet of the vessel.

17. The method of claim 16, comprising directing solids to the solids outlet using a bottom of the vessel that is sloped downward toward the solids outlet.

* * * * *